US008570260B2

(12) United States Patent
Hedtke et al.

(10) Patent No.: US 8,570,260 B2
(45) Date of Patent: Oct. 29, 2013

(54) LCD DESIGN FOR COLD TEMPERATURE OPERATION

(75) Inventors: Robert C. Hedtke, Young America, MN (US); Vladimir Victorovich Repyevskiy, Chelyabinsk (RU)

(73) Assignee: Rosemount Inc., Eden Prairie, MN (US)

( * ) Notice: Subject to any disclaimer, the term of this patent is extended or adjusted under 35 U.S.C. 154(b) by 693 days.

(21) Appl. No.: 11/992,578

(22) PCT Filed: Oct. 19, 2006

(86) PCT No.: PCT/RU2006/000539
§ 371 (c)(1),
(2), (4) Date: Mar. 24, 2010

(87) PCT Pub. No.: WO2007/046731
PCT Pub. Date: Apr. 26, 2007

(65) Prior Publication Data

US 2010/0207913 A1 Aug. 19, 2010

Related U.S. Application Data

(60) Provisional application No. 60/728,265, filed on Oct. 19, 2005.

(51) Int. Cl.
*G09G 3/36* (2006.01)

(52) U.S. Cl.
USPC ..... 345/87; 345/204

(58) Field of Classification Search
USPC ..... 345/87–104, 204–215
See application file for complete search history.

(56) References Cited

U.S. PATENT DOCUMENTS 3,907,405 A * 9/1975 Fukai et al. ..... 345/101
4,622,635 A 11/1986 Chandra et al. ..... 364/422
4,902,107 A * 2/1990 Tsuboyama et al. ..... 349/72

(Continued)

FOREIGN PATENT DOCUMENTS

DE 10 2004 014672 10/2005
JP 04070693 6/1992
JP 2001-331144 11/2001
JP 2004-104209 4/2004

OTHER PUBLICATIONS

Office Action from U.S. Appl. No. 11/581,886, now abandoned.

(Continued)

*Primary Examiner* — Amare Mengistu
*Assistant Examiner* — Dmitriy Bolotin
(74) *Attorney, Agent, or Firm* — Westman, Champlin & Kelly, P.A.

(57) ABSTRACT

A method (200) of controlling a liquid crystal display (LCD) (110) integrated within a sensing device for operation in cold temperature is provided. The method (200) includes providing electrical power to the LCD (110), providing an electrical signal to the LCD (110) to update displayed information, measuring (206) the ambient temperature proximate the LCD (110) and making adjustments to the power and update information supplied to the LCD (110) based on the ambient temperature. Another aspect of the invention includes a field device (10) including an LCD (110), an electronic control module (120) configured to provide power and communication signals to the LCD (110), and a temperature sensor (112) coupled to the electronic control module (120). The electronic control module (120) is configured to measure the temperature proximate the LCD (110) and control power and communication supplied to the LCD (110) based on the temperature at the LCD (110).

14 Claims, 6 Drawing Sheets

(56) References Cited

U.S. PATENT DOCUMENTS

| | | | | |
|---|---|---|---|---|
| 4,923,285 | A * | 5/1990 | Ogino et al. | 345/101 |
| 5,029,982 | A * | 7/1991 | Nash | 349/72 |
| 5,033,822 | A * | 7/1991 | Ooki et al. | 345/101 |
| 5,204,660 | A * | 4/1993 | Kamagami et al. | 345/95 |
| 5,276,542 | A * | 1/1994 | Iwayama et al. | 345/101 |
| 5,717,420 | A * | 2/1998 | Matsuzaki et al. | 345/97 |
| 5,717,421 | A * | 2/1998 | Katakura et al. | 345/101 |
| 5,754,154 | A * | 5/1998 | Katakura et al. | 345/97 |
| 5,757,352 | A * | 5/1998 | Miyamoto et al. | 345/101 |
| 6,089,751 | A * | 7/2000 | Conover et al. | 374/183 |
| 6,496,177 | B1 * | 12/2002 | Burton | 345/101 |
| 6,930,667 | B1 * | 8/2005 | Iijima et al. | 345/101 |
| 2002/0140652 | A1 * | 10/2002 | Suzuki et al. | 345/87 |
| 2003/0231157 | A1 | 12/2003 | Sugino et al. | |
| 2004/0041762 | A1 * | 3/2004 | Naiki et al. | 345/87 |
| 2004/0150606 | A1 | 8/2004 | Preston | 345/100 |
| 2004/0252111 | A1 * | 12/2004 | Cheon et al. | 345/204 |
| 2005/0041007 | A1 | 2/2005 | Iijima | |
| 2005/0155839 | A1 * | 7/2005 | Banks et al. | 194/302 |
| 2007/0001993 | A1 * | 1/2007 | Koizumi et al. | 345/101 |
| 2007/0085807 | A1 * | 4/2007 | Hedtke | 345/98 |

OTHER PUBLICATIONS

International Search Report and Written Opinion for application No. PCT/RU2006/000539, dated Mar. 30, 2007.

Final Office Action for the corresponding Japanese patent application No. 2008-536536 dated Sep. 27, 2011.

Office Action for the corresponding Canadian patent application No. 2,622,378 dated Sep. 26, 2011.

Third (Final) Office Action for the corresponding Japanese patent application No. 2008-536536 dated Apr. 10, 2012.

Office Action from the corresponding Canadian patent application No. 2622378, dated Aug. 21, 2012. 3 pages.

* cited by examiner

LCD DESIGN FOR COLD TEMPERATURE OPERATION

CROSS-REFERENCE TO RELATED APPLICATION

This Application is a Section 371 National Stage Application of International Application No. PCT/RU2006/000539, filed Oct. 19, 2006 and published as WO 2007/046731 A3 on Apr. 26, 2007.

BACKGROUND

Field devices such as process variable transmitters, are used in the process control industry to remotely sense a process variable. Field devices such as actuators, are used by the process control industry to remotely control physical parameters of a process, such as flow rate, temperature, et cetera. The process variable may be transmitted to a control room from a field device such as a process variable transmitter for providing information about the process to a controller. The controller may then transmit control information to a field device such as an actuator to modify a parameter of the process. For example, information related to pressure of a process fluid may be transmitted to a control room and used to control a process such as oil refining.

Process variable transmitters are used to monitor process variables associated with fluids such as slurries, liquids, vapors and gasses in chemical, pulp, petroleum, gas, pharmaceutical, food and other fluid processing plants. Process variables include pressure, temperature, flow, level, pH, conductivity, turbidity, density, concentration, chemical composition and other fluid properties. Process actuators include control valves, pumps, heaters, agitators, coolers, solenoids, vents and other fluid controlling devices.

SUMMARY

A method of controlling a liquid crystal display (LCD) integrated within a sensing device for operation in cold temperature is provided. The method includes providing electrical power to the LCD, providing an electrical signal to the LCD to update displayed information, measuring the ambient temperature proximate the LCD and making adjustments to the power and update information supplied to the LCD based on the ambient temperature. Another aspect of the invention includes a field device including an LCD, an electronic control module configured to provide power and communication signals to the LCD, and a temperature sensor coupled to the electronic control module. The electronic control module is configured to measure the temperature proximate the LCD and control power and communication supplied to the LCD based on the temperature at the LCD.

DETAILED DESCRIPTION

Figure 1:
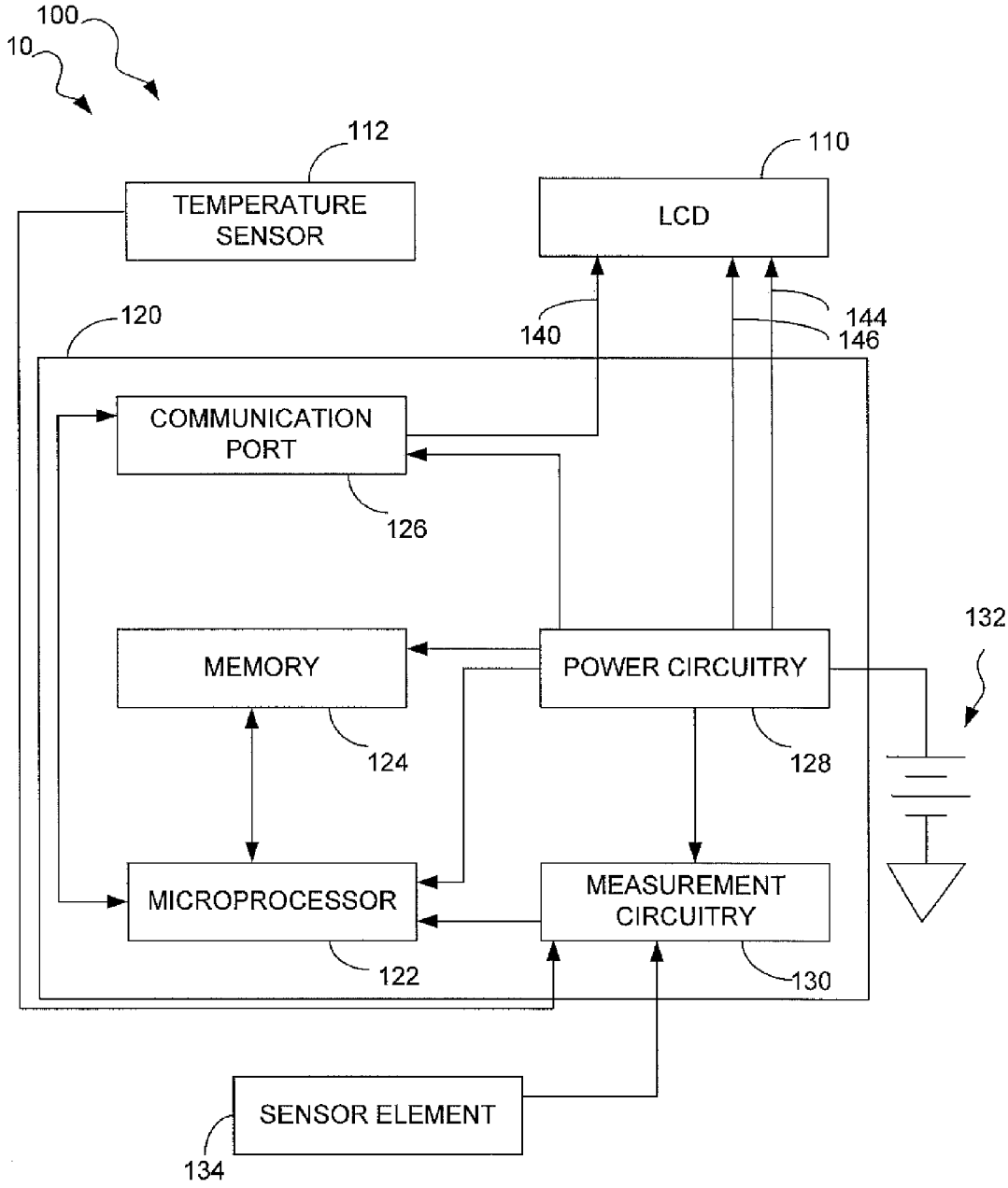
FIG. 1 is a diagrammatic view of a field device of the type useful with embodiments of the present invention.

FIG. 1 illustrates a schematic diagram of a portion of field device 10 according to one embodiment of the invention. Field device 10 includes a liquid crystal display (LCD) 110, which is coupled to electronic control module 120. Electronic controller module 120 includes, in one embodiment, controller 122 coupled to memory device 124 and communication port 126. Controller 122 can be a controller, processor, application specific integrated circuitry (ASIC) or any other acceptable control device circuitry. Power circuitry 128 is coupled to controller 122, memory 124, and communication port 126, as well as measurement circuitry 130 which may be a part of electronic control module 120.

Power circuitry 128 receives electrical power from power source 132. Power source 132 can be any type of suitable electrical power source including a battery, an AC power source, a process control loop, or any other device.

Filed device 10 includes sensor 134 coupled to electronic control module 120. Sensor 134 provides an input signal relative to a parameter to be measured by field device 10. Sensor 134 can include one or more sensor elements utilizing any suitable technology. Sensor 134 may be disposed integral with LCD 110, and is electrically coupled to measurement circuitry 130 which may include known sensor input handling circuitry. Field device 10 also includes a temperature sensor 112 coupled to electronic control module 120 via measurement circuitry 130. Temperature sensor 112 senses ambient temperature proximate LCD 110. Temperature sensor 112 can utilize any acceptable technology including thermocouples, resistance temperature devices (RTD) and/or thermoswitches/thermostats. Temperature sensor 112 is shown electrically coupled to measurement circuitry 130 but it is to be understood that temperature sensor 112 can be in electrical communication with communication port 126 or any other communication handling circuitry including being directly coupled to controller 122 without departing from the scope of the invention.

Schematic diagram 100 is a functional schematic and it is to be understood that other implementations of electronic circuitry within field device 10 may be implemented without departing from the scope of the invention. For example, memory 124 and/or communication port 126 may be physically incorporated within controller 122. Power circuitry 128 can include any embodiments of power circuitry including regulators, voltage dividers, current limiters, and the like. LCD 110 can be a commercially available device, a custom design liquid crystal display of any size or shape, and can have any manner of electrical communication with electronic control module 120 for the purposes of receiving data from electronic control module 120.

LCDs such as LCD 110 have a limited temperature operation range. For example, some LCDs having an operating range that extends only to −4° F. (−20° C.). Other LCDs may have operating ranges that are specified to be higher or lower in temperature than −4° F. Embodiments of the present invention can be applied to any LCD with any operating temperature.

Figure 2:
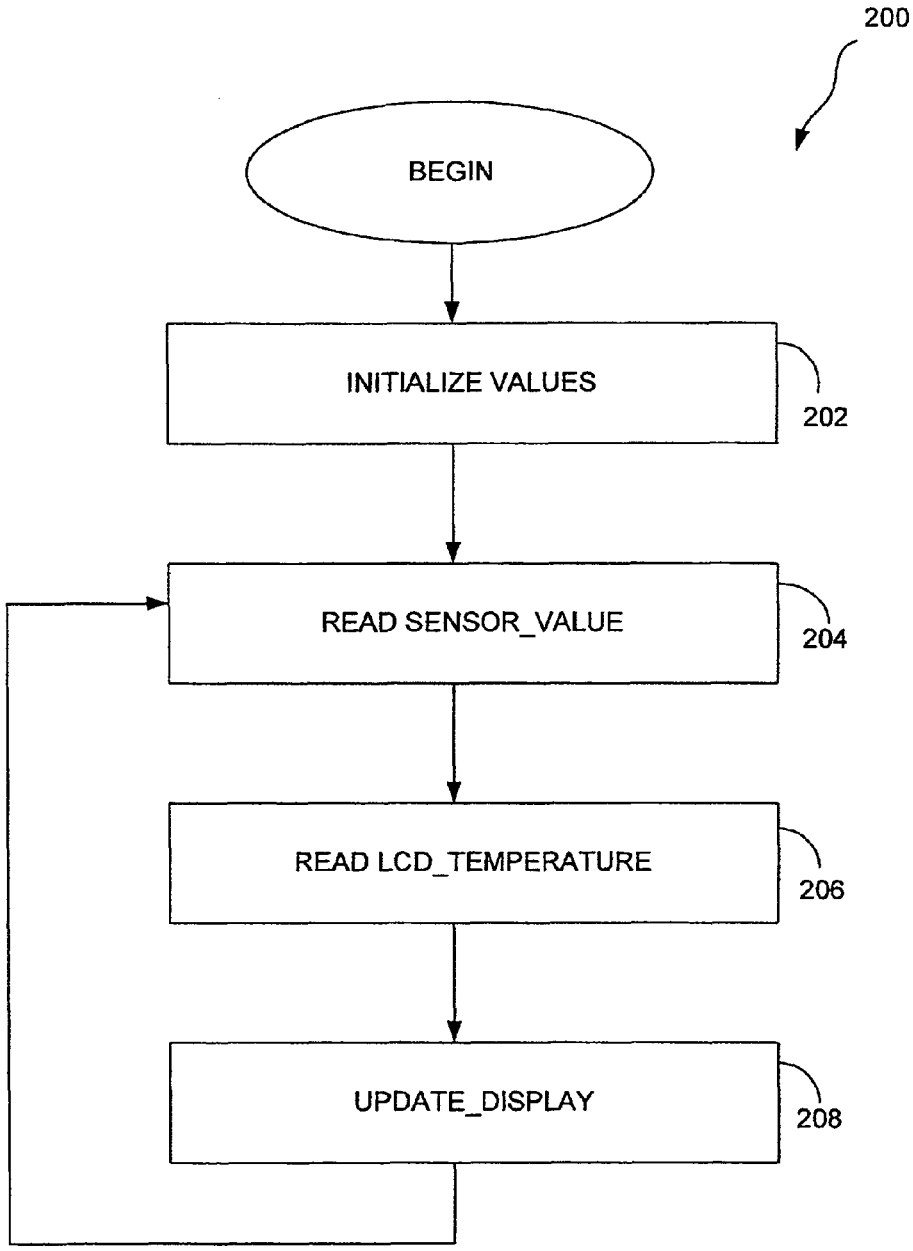
FIG. 2 is a flow diagram illustrating operation of a field device to extend the operation of an LCD below its rated operating temperature in accordance with an embodiment of the present invention.
Figure 3:
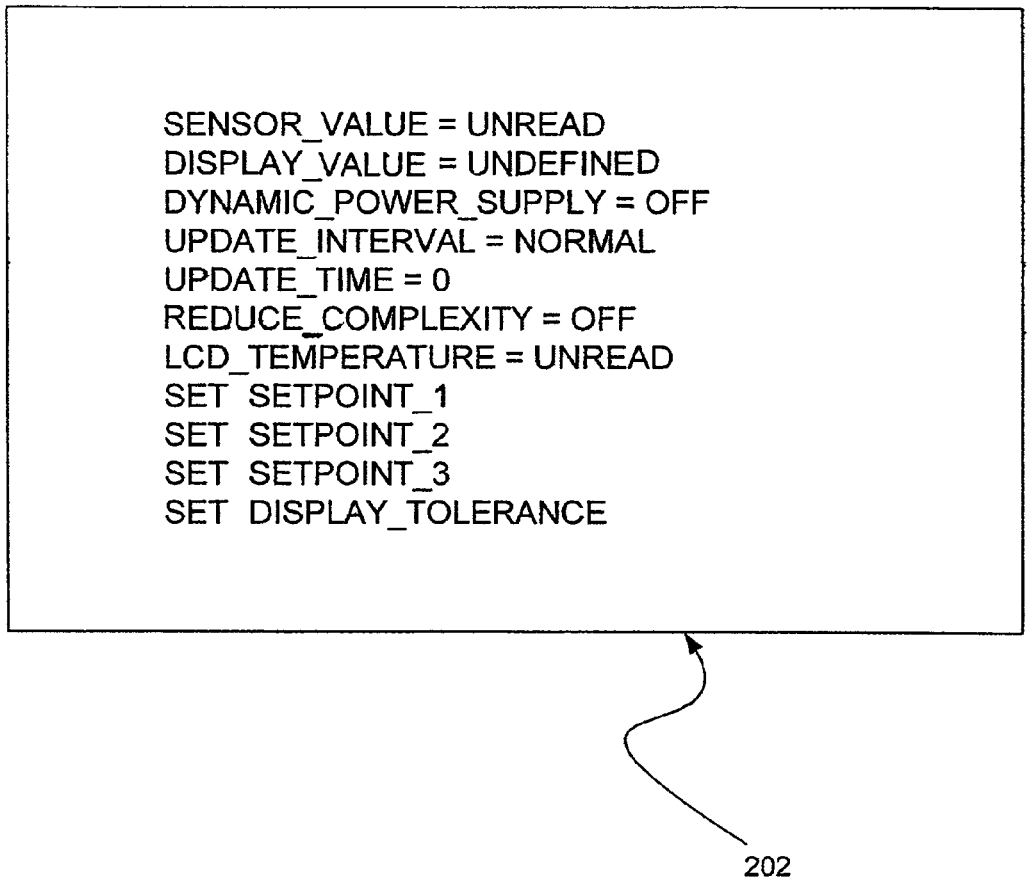
FIG. 3 provides a list of parameters and their initial values in accordance with an embodiment of the present invention.

FIG. 2 is a flow diagram illustrating method 200 describing the operation of field device 10 to extend the operation of LCD 110 below its rated operating temperature in accordance with an embodiment of the present invention. In block 202, the electronic control module 120 initializes necessary parameters for variables used in the invention. Referring briefly to FIG. 3, a list of parameters and their initial values are identified. For example, Sensor_Value is defined as unread, Display_Value is defined as undefined, and Dynamic_Power_Supply is defined as off. Other parameters such as Setpoint_1 are set to values that, in one embodiment, are stored in memory 124 of electronic control module 120. The significance of the parameters listed in FIG. 3 will become more apparent as the function of electronic control module 120 is described in greater detail below.

Once the step of initializing the parameters is performed at block 202, electronic control module 120 will read sensor value 204 from sensor 134. Then, electronic control module 120 will read the LCD temperature from temperature sensor 112 as shown in block 206. Once both the sensor value and the temperature value have been obtained, electronic control module 120 will update display LCD 110, as shown in block 208. Electronic control module 120 then cycles back to block 204 to repeat the process of reading the sensor value, receiving the temperature value, and updating the display.

Step 204 of reading the sensor value from sensor 134 can be accomplished in any number of ways. As described above, the sensor element may be electrically communicating with measurement circuitry 130. Further, the step of reading the sensor value may include any number of techniques to provide a single value. As an example, electronic control module 120 may read several values from sensor 134 and perform an averaging function to eliminate or deal with hysteresis or potential spikes in sensor readings. Any acceptable routine to read and process the sensor value can be used without departing from the scope of the invention.

Figure 4:
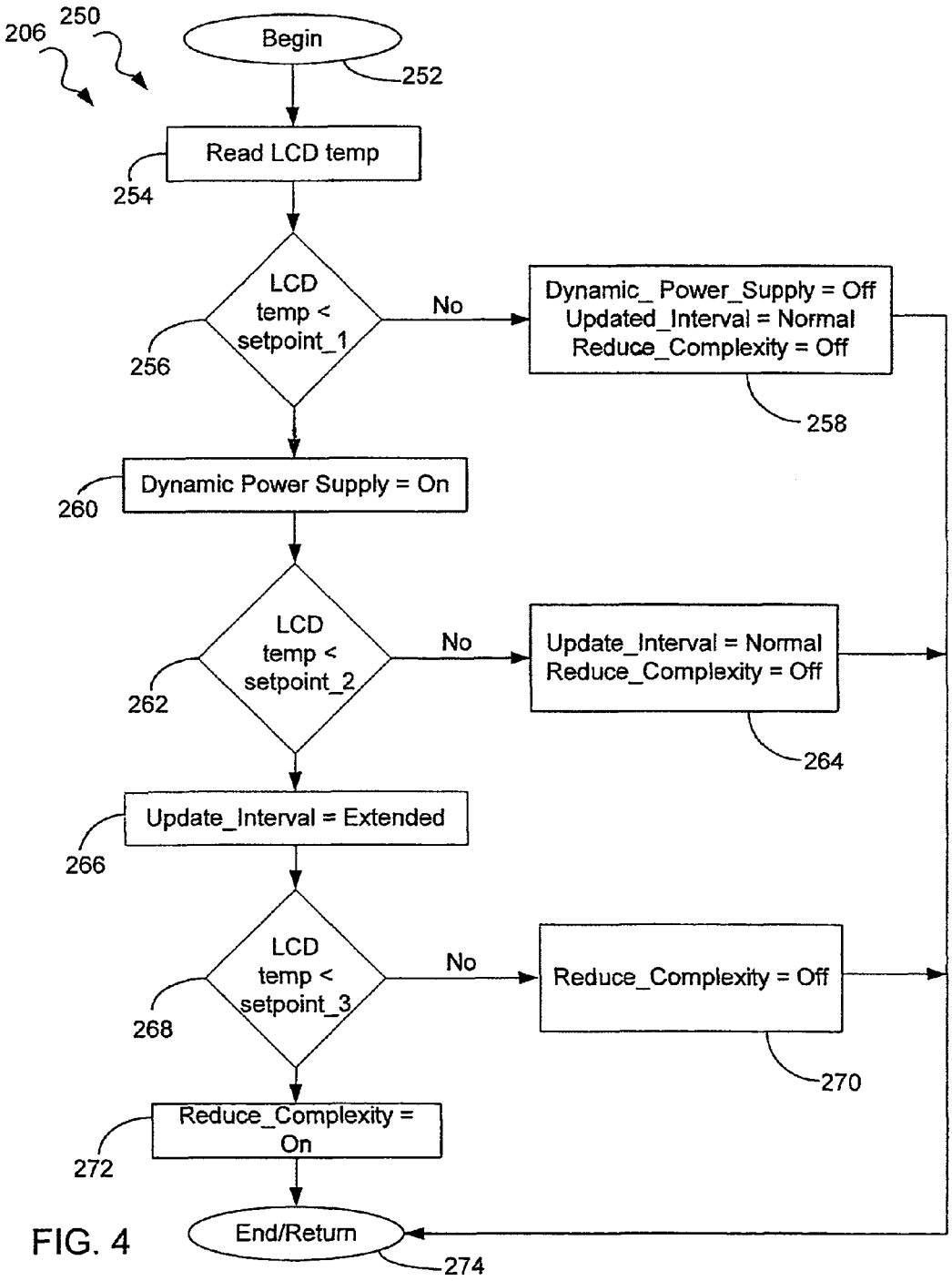
FIG. 4 is a flow diagram of a method of reading LCD temperature in accordance with an embodiment of the present invention.

FIG. 4 is a flow diagram of method 250 that comprises step 206 of reading the LCD temperature in greater detail according to one embodiment of the invention. After beginning in block 252, the electronic control module 120 read LCD temperature from the temperature sensor 112. As with step 204 described above, any number of sensor input routines can be employed to provide a value for the LCD temperature. Once the LCD temperature has been read, it is compared against a Setpoint_1 in decision block 256. If the LCD temperature is not less than Setpoint_1, Dynamic_Power_Supply is set to Off, Update_Interval is set to Normal and Reduced_Complexity is set to Off. At this point, the function 206 of reading the LCD temperature is completed and electronic control module 120 moves to block 274 which is the end of the routine.

Returning again to block 256, if the LCD temperature is less than Setpoint_1, the Dynamic_Power_Supply is set to On as described in block 260. Once the Dynamic_Power_Supply is set to On, electronic control module 120 will provide additional power to LCD 110. In one embodiment, a second LCD power source 146 is supplied, or otherwise coupled, to the LCD in addition to first LCD power source 144. Alternatively, additional power is supplied on the first LCD power source line 144 from the power circuitry to the LCD. Additional power provided to the LCD can be diverted from other circuitry within electronic control module 120. At lower temperatures, a number of the electrical devices within electronic control module 120 may require less power. Thus, this power can be supplied to the LCD 110 without affecting the function of any component within electronic control module 120. Power circuitry 128 can include any type of circuitry required to divert power from other devices to the LCD display. Additionally, or in the alternative, a any suitable temperature sensitive element can be sensed, or used, to dynamically vary the power to the LCD based upon temperature. A temperature sensitive diode can be used, such that as the temperature drops, the diode voltage drops as well. The voltage drop can be sensed and more power can be supplied to the LCD drivers.

Once the Dynamic_Power_Supply has been set to On, in block 260, the electronic control module 120 then moves to decision block 262 to determine whether the LCD temperature is less than Setpoint_2. It is to be understood that in one embodiment, Setpoint_2 is in a lower value than Setpoint_1. For example, Setpoint_2 in one embodiment is −15° F. (−26° C.). Setpoint_2 can vary depending on the rated operating temperature of the LCD 110. If the LCD temperature is not less than Setpoint_2, electronic control module 120 moves to block 264 in which Update_Interval is set to Normal and Reduced_Complexity is set to Off. Electronic control module 120 then moves to block 274, which represents the end of step 206 of reading the LCD temperature.

Returning again to block 262, if it is determined that the LCD ambient temperature is less than Setpoint_2, electronic control module 120 moves to block 266 and Update_Interval is set to extended. Update_Interval determines the length of time that elapses between updates of the LCD display. When the LCD ambient temperature is above Setpoint_2, Update_Interval is set to Normal. In one embodiment, Normal has a value, or otherwise corresponds to, an update interval of three seconds. Thus, when Update_Interval is set to Normal, the LCD is updated every three seconds. Alternatively, the value assigned to Normal can be any number that provides an acceptable rate of update to the display when the LCD ambient temperature is higher than Setpoint_1. In one embodiment, the value assigned to Extended is six seconds. Thus, when the ambient temperature at the LCD is below Setpoint_2, the display would be updated every six seconds. The value assigned to extended can be any value which provides acceptable update rates to the LCD when the temperature is below Setpoint_2. For example, the value assigned to Extended could be eight seconds, ten seconds, or twenty seconds. Alternatively, Extended can be set to different values, depending how far below Setpoint_2 the LCD ambient temperature is.

Once Update_Interval has been set to Extended in block 266, electronic control module 120 compares the ambient LCD temperature to Setpoint_3 in block 268. It should be appreciated that Setpoint_3 is a lower temperature value then that of Setpoint_2. In one embodiment, Setpoint_3 is set to −28° F. (−33.3° C.). The value of Setpoint_3 can be any value which corresponds to the point at which additional steps need to be taken beyond extending the update rate and providing additional power to the LCD as taken above. If it is determined that the LCD ambient temperature is higher than Setpoint_3, Reduced_Complexity is turned off in step 270 and electronic control module 120 moves to step 274 which is the end of the set temperature function.

Returning to block 268, if the ambient LCD temperature, however, is lower than Setpoint_3, Reduced_Complexity 272 is set to On. The implications of having Reduced_Complexity set to On will be discussed later with respect to the process of updating the display corresponding to block 208. Once Reduced_Complexity has been set to On in step 272, electronic control module 120 moves to step 274, which represents the end of the step 206 of reading the LCD temperature.

Figure 5A:
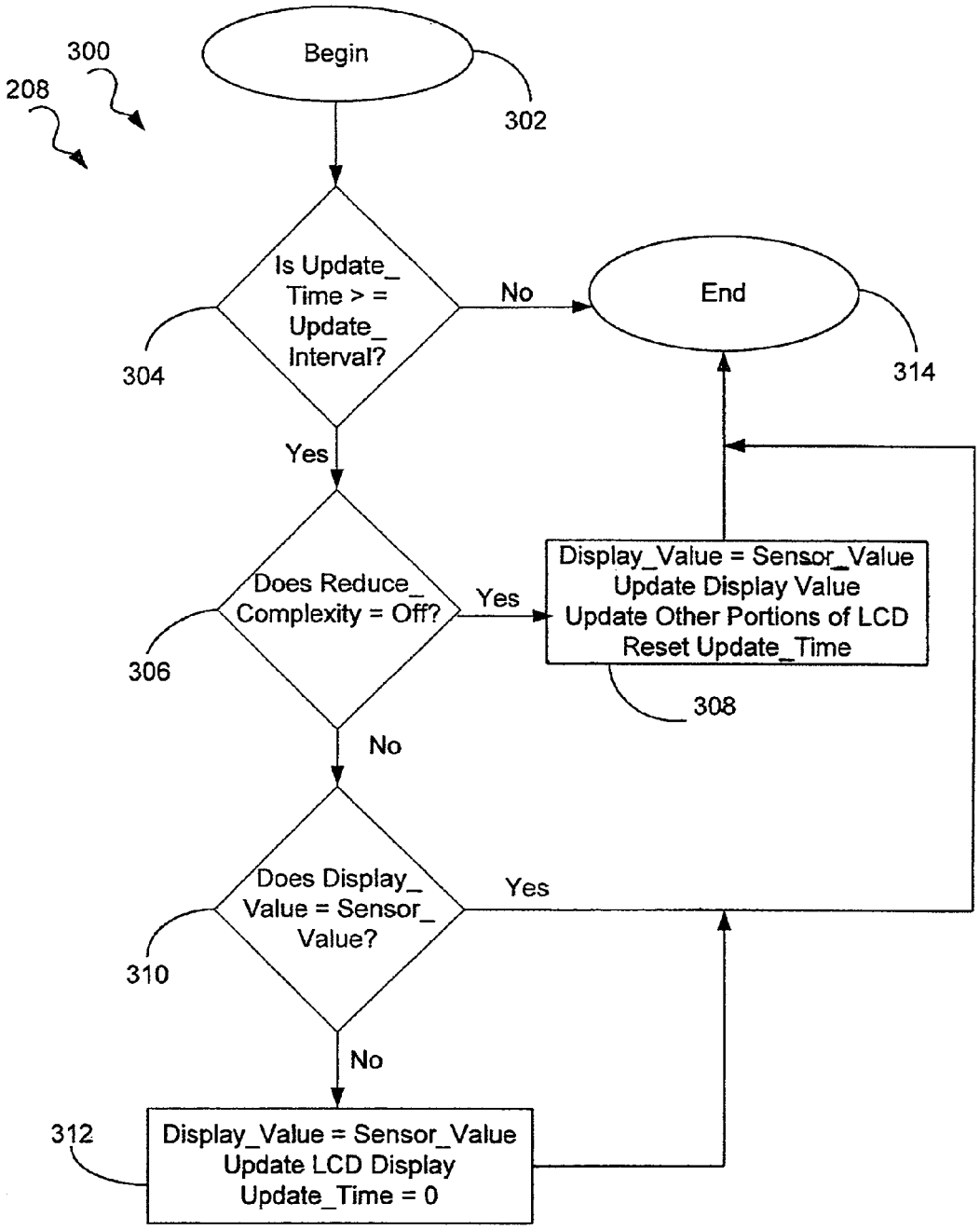
FIG. 5A is a flow diagram illustrating a step of updating the LCD display in accordance with an embodiment of the present invention.

Referring to FIG. 5A flow diagram 300 provides a functional description of step 208 of updating the LCD display performed by electronic control module 120 according to one embodiment of the invention. Beginning at block 302, electronic control module 120 moves to decision block 304 where it compares Update_Time value to Update_Interval value. Update_Time is a timer that keeps track of the amount of time that has elapsed since the last time the LCD display has been updated. If Update_Time is not equal to or greater than Update_Interval, electronic control module 120 moves to block 314 which represents the end of the update display function. Alternatively, electronic control module 120 can remain at block 304 until Update_Time is greater than Update_Interval.

If it is determined that Update_Time is indeed greater than Update_Interval, electronic control module 120 moves to block 306. At block 306, the electronic control module 120 checks to see the status of Reduced_Complexity. If Reduced_Complexity is set to Off, electronic control module 120 moves to block 308. At block 308, the electronic control module 120 assigns the display variable to the value of the sensor value variable. The display is then updated with all of the information that is provided normally to the display. That information includes in one embodiment, a display value, and an engineering unit associated with that display value. Alternatively, any number of items can be included on the LCD display. Once the display has been updated, Update_Time is reset and electronic control module 120 moves to block 314 which represents the end of the update display routine.

Returning again to block 306, if the electronic control module 120 determines that Reduced_Complexity is set to On, electronic control module 120 moves to decision block 310. At decision block 310, the Display_Value is compared to the sensor value. If the Display_Value equals the sensor value, the display is not updated and electronic control module 120 moves to block 314 which represents the end of the updated display function. However, if the Display_Value is not equal to the sensor value, electronic control module 120 moves to block 312, where the Display_Value is set to the sensor value. Then, the display is updated with the new Display_Value. However, no other elements on the display are updated. It is possible that the only visible element on the display 110 will be the sensor value itself. Once the LCD display has been updated, Update_Time is reset to zero and the electronic control module 120 moves to block 314 which represents the end of the update display routine.

Figure 5B:
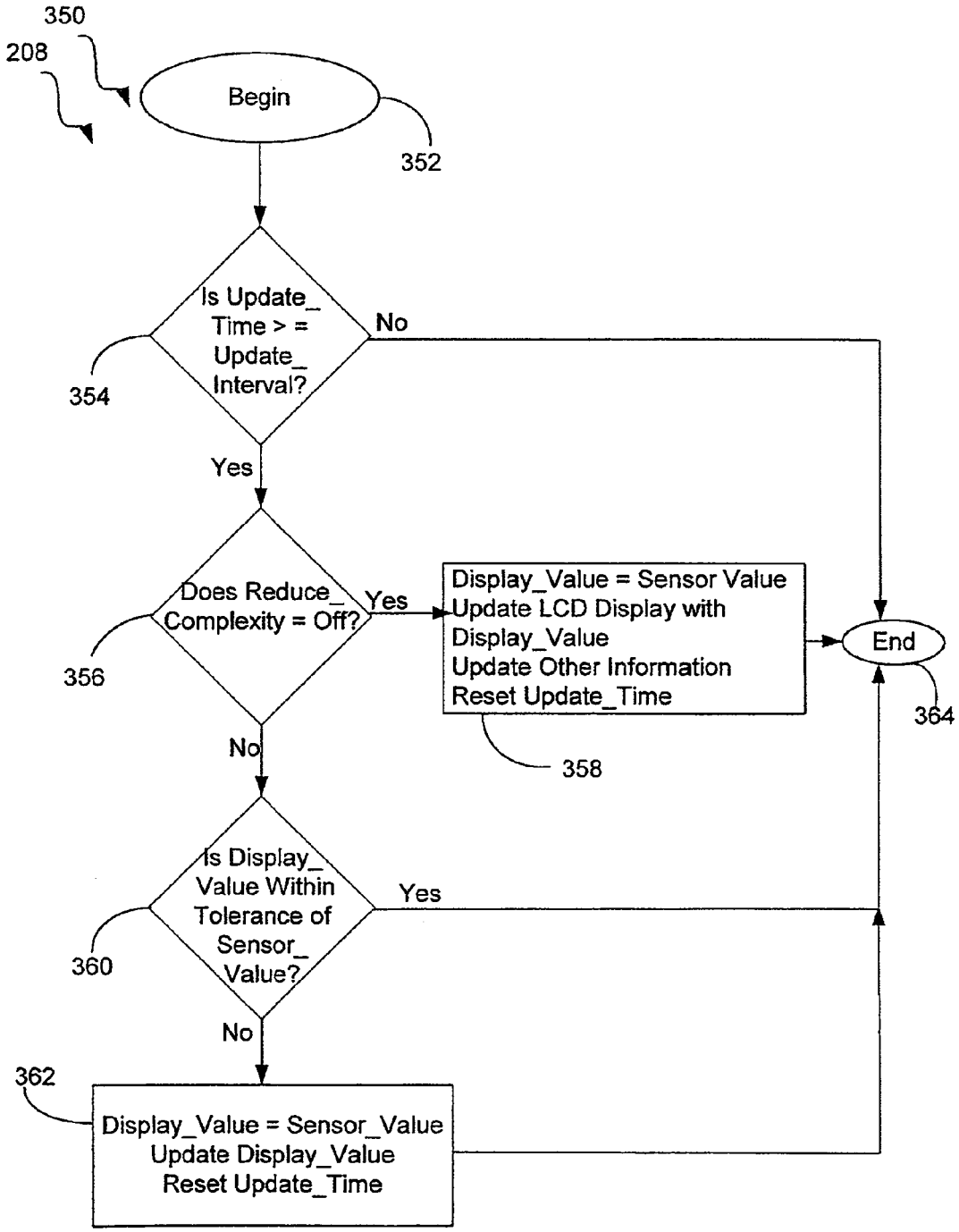
FIG. 5B is a flow diagram illustrating an alternate step of updating the LCD display in accordance with an embodiment of the present invention.

Referring to FIG. 5B, flow diagram 350 provides a functional description of update display step 208 according to another embodiment of the invention. Electronic control module 120 begins at block 352 and moves to decision block 354. At decision block 354, Update_Time is compared to Update_Interval. If Update_Time is not equal to or greater than Update_Interval, electronic control module 120 moves to block 364 which represents the end of the update display routine.

Returning again to block 354, if Update_Time is greater than or equal to Update_Interval, then electronic control module 120 moves to decision block 356. At block 356, if Reduced_Complexity is set to Off, electronic control module 120 moves to block 358. At block 358, the Display_Value is set to sensor value, the LCD display is updated with the value of Display_Value, as well all other information that might be visible on display 110. Update_Time is then reset to zero and electronic control module 120 moves to block 364, the end of step 208. Returning again to block 356, if Reduced_Complexity is set to On, electronic control module 120 moves to block 360. At block 360, a Display_Value is compared to the sensor value. If the Display_Value is equal to the sensor value, or is within a given tolerance of the sensor value, electronic control module 120 moves to block 364, the end of step 208. Tolerance is a value set in the initialized value step 202. While the Tolerance variable is, in one embodiment, assigned a single, unchanging value, Tolerance can alternatively have a plurality of different values, corresponding to different tolerance values depending upon how far the ambient LCD temperature is below Setpoint_3. By changing the LCD display value only when the Sensor_Value differs from Display_Value by more than the value of Tolerance, some accuracy may be sacrificed on the LCD 110. However, the LCD 110 may function at a lower temperature because the display is not updated as often.

Returning again to block 360, if Display_Value differs from Sensor_Value by more than the value assigned to Tolerance, the Display_Value is set to the Sensor_Value and the display value is updated onto LCD 110. It is to be understood that no other portions of the display which may be visible will be updated. For example, an engineering unit which may normally be displayed will not be updated. Update_Time is then reset and electronic control module 120 moves to block 364 which is the end of the update display function.

While the embodiments shown in FIGS. 5A and 5B and described above differ in their approach to handling the display when the temperature is below Setpoint_3, it is to be understood that in an alternate embodiment, an additional Setpoint, having a lower temperature than Setpoint_3, could be implemented. In such an embodiment, the display may not be updated until the sensor value is different from the Display_Value when the temperature is below Setpoint_3. When the temperature is below the additional Setpoint however, the Tolerance value is considered and the display value would be updated only when the Display_Value is not within the tolerance level of the sensor value. Such an embodiment would limit the amount of time that a tolerance is considered when comparing the Display_Value and the sensor value, thereby reducing the likelihood that the display value is not exactly what the sensor value is at any given moment.

Although the present invention has been described with reference to several alternative embodiments, workers skilled in the art will recognize that changes may be made in form and detail without departing from the spirit and the scope of the invention.

What is claimed is:

1. A method of controlling a liquid crystal display (LCD) within a field device for operation in cold temperature, the method comprising:

providing a first electrical power level to the LCD for operating the LCD;

providing an electrical signal to the LCD to update information displayed on the LCD;

providing a first temperature setpoint;

measuring an ambient temperature proximate the LCD;

providing a second electrical power level to the LCD when the measured ambient temperature is lower than the first temperature setpoint;

setting an update interval to a first length of time, wherein the step of providing the electrical signal to the LCD to update information displayed on the LCD is performed periodically at the update interval;

providing a second temperature setpoint;

setting the update interval to a second length of time when the measured ambient temperature is lower than the second temperature setpoint, wherein the second length of time is longer than the first length of time;

providing a third temperature setpoint; and wherein the step of providing the electrical signal to the LCD provides information to update only a portion of the LCD when the measured ambient temperature is lower than the third temperature setpoint.

2. The method of claim 1, wherein the step of setting the update interval to the first length of time includes setting the update interval to three seconds.

3. The method of claim 1, wherein the step of setting the update interval to the second length of time includes setting the update interval to six seconds.

4. The method of claim 1, wherein the step of providing the electrical signal to the LCD includes providing information to update a sensor value and an engineering unit on the LCD and wherein the step of providing the electrical signal to the LCD includes providing only the information to update a sensor value when the measured ambient temperature is lower than the third temperature setpoint.

5. The method of claim 4, wherein the step of providing the electrical signal to the LCD when the measured ambient temperature is lower than the third temperature setpoint is performed only when the information to update the sensor value is different from the information to update the sensor value sent in a previous update.

6. A field device for use in an industrial process, the field device comprising:

a liquid crystal display (LCD);

an electronic control module having a memory, wherein the electronic control module is coupled to the LCD and is configured to provide a power signal and a communication signal to the LCD;

a temperature sensor operably coupled to the electronic control module, the temperature sensor being configured to provide an indication relative to ambient temperature proximate the LCD; wherein the electronic control module is configured to provide the power signal and the communication signal based on the ambient temperature;

wherein the memory stores information relative to a first temperature set point, and wherein the electronic control module is configured to provide the power signal to the LCD when the measured ambient temperature is below the first temperature set point;

wherein the electronic control module is coupled to power supply circuitry for providing electrical power to the electronic control module;

wherein the electronic control module is configured to divert a portion of the power otherwise provided to the electronic control module to the LCD; and wherein the memory stores information relative to a third temperature set point and wherein the electronic control module is configured to update only a portion of the LCD when the ambient temperature is below the third temperature set point.

7. The field device of claim 6, wherein the temperature sensor is integral to the LCD.

8. The field device of claim 6, wherein the memory stores information relative to a time interval, and wherein the electronic control module is configured to provide the communication signal periodically at a frequency defined as the time interval.

9. The field device of claim 8, wherein the memory stores information relative to a second temperature set point, and wherein the electronic control module is configured to assign a first value to the time interval when the ambient temperature is above the second temperature set point and to assign a second value to the time interval when the ambient temperature is below the second temperature set point.

10. The field device of claim 9, wherein the first value is three seconds.

11. The field device of claim 9, wherein the second value is six seconds.

12. The field device of claim 11, wherein the electronic control module is configured to update sensor information and engineering unit information on the LCD, and wherein the electronic control module is configured to update only the sensor information when the ambient temperature is below the third temperature set point.

13. The field device of claim 12, wherein the electronic control module is configured to only update the sensor information if the sensor information has changed.

14. The field device of claim 13, wherein the electronic control module is configured to only update the sensor information if the sensor information has changed by more than a given amount.

* * * * *

UNITED STATES PATENT AND TRADEMARK OFFICE

CERTIFICATE OF CORRECTION

PATENT NO. : 8,570,260 B2
APPLICATION NO. : 11/992578
DATED : October 29, 2013
INVENTOR(S) : Hedtke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1363 days.

Signed and Sealed this
Twenty-second Day of September, 2015

Michelle K. Lee

Michelle K. Lee
*Director of the United States Patent and Trademark Office*